US006263702B1

(12) United States Patent
Lo

(10) Patent No.: US 6,263,702 B1
(45) Date of Patent: Jul. 24, 2001

(54) STRUCTURE OF AN ORNAMENTAL ACCESSORY

(75) Inventor: Chin-Tien Lo, Taoyuan Hsien (TW)

(73) Assignee: Tien Chung Ent. Co., Ltd., Taoyuan Hsien (TW)

( * ) Notice: Subject to any disclaimer, the term of this patent is extended or adjusted under 35 U.S.C. 154(b) by 0 days.

(21) Appl. No.: 09/330,186

(22) Filed: Jun. 11, 1999

(51) Int. Cl.[7] ..... A44C 13/00

(52) U.S. Cl. ..... 63/1.11; 63/1.16; 63/20; 63/23; 40/1.5; 40/1.6; 606/234; 24/516

(58) Field of Search ..... 63/1.11, 1.16, 63/20, 23; 40/1.5, 1.6; 606/234; 24/513, 515, 516, 502, 503, 504

(56) References Cited

U.S. PATENT DOCUMENTS

| | | | | |
|---|---|---|---|---|
| 517,278 | * | 3/1894 | Hoyt | 24/516 |
| 867,655 | * | 10/1907 | Gutmann | 24/516 |
| 881,372 | * | 3/1908 | Buchanan | 24/516 |
| 1,040,918 | * | 10/1912 | Fischer | 24/712.2 |
| 1,446,179 | * | 2/1923 | Henkes | 63/23 |
| 2,237,731 | * | 4/1941 | Freysinger | 24/516 |
| 3,392,729 | * | 7/1968 | Lenoir | 606/234 |
| 3,531,835 | * | 10/1970 | Paikin | 24/516 |
| 4,005,510 | * | 2/1977 | Noda | 24/504 |
| 4,141,119 | * | 2/1979 | Nodo | 24/504 |
| 4,765,037 | * | 8/1988 | Perry | 24/301 |
| 4,918,847 | * | 4/1990 | Lee | 40/745 |
| 4,990,157 | * | 2/1991 | Roberts et al. | 606/234 |
| 5,052,081 | * | 10/1991 | Fuehrer | 24/35 |
| 5,948,003 | * | 9/1999 | Shefflin | 606/234 |
| 5,954,749 | * | 9/1999 | Fields et al. | 606/234 |
| 5,964,784 | * | 10/1999 | Wang | 606/234 |

* cited by examiner

*Primary Examiner*—Anthony Knight
*Assistant Examiner*—Andrea Chop
(74) *Attorney, Agent, or Firm*—Dougherty & Troxell

(57) ABSTRACT

An ornamental accessory includes a face plate, a trigger plate, and a movable clamp plate. The face plate has a rear side provided with a plate groove with plate wings projecting from both sides of the plate groove. The trigger plate is pivotally connected to the plate wings and has an L-shaped rod neck with trigger pieces extending from an end portion. The movable clamp plate has a clamp body having a top portion with two inverted L-shaped plate hooks and is pivotally connected to the plate wings. Each plate hook has an inner portion forming a rod recess, with a stop boss projecting from one end. When the trigger plate is pulled, the rods advance along inner walls of the plate hooks into said rod recesses to move the clamp plate.

10 Claims, 4 Drawing Sheets

STRUCTURE OF AN ORNAMENTAL ACCESSORY

BACKGROUND OF THE INVENTION (a) Field of the Invention

The present invention relates to an improved structure of an ornamental accessory.

(b) Description of the Prior Art

Ornamental accessories for clothing generally include an ornament portion and a fastening pin or clip on a rear side thereof adapted to fasten to a part of the wearer's clothing. In order to conceal the fastening pin or clip behind the ornament portion, the fastening pin or clip is sized to be smaller than the ornament portion. By means of the fastening pin or clip, the wearer can fasten or detach the ornamental accessory to or from his/her clothing.

FIG. 1 illustrates a conventional ornamental accessory for clothing. It mainly includes a disk body A of a plastic material and a metal clip B riveted to a rear side of the disk body A. By pressing the metal clip B, a clipping portion is opened to allow the wearer to fasten the ornamental accessory to his/her clothing. If the ornamental accessory is adapted for use as pacifier clip, the disk body A is provided with an opening C that is internally provided with a projection for connection with a chain D. Since the metal clip B is punched into shape and then undergoes electroplating process before assembly, the punching of the metal clip B will generate burrs, which may cause scratching. In addition, if the user (mother) holds the baby (wearer), the metal clip B will, due to intimate body contact, open so that the pacifier clip slips from the wearer's clothing. It can therefore be seen that the conventional pacifier clip is very inconvenient.

Furthermore, although the above-mentioned ornamental accessory can be fastened to the wearer's clothing, since it includes a metal elastic plate or small elements, apart from being time-consuming in terms of assembly, the parts may become detached and may be swallowed by babies. In addition, since the ornament is fastened to the wearer's clothing by means of the metal clip, it may slip. Furthermore, according to the GE standard set by the European Community in 1998, the conventional ornament as shown in FIG. 1 is not up to the standard.

SUMMARY OF THE INVENTION

A primary object of the present invention is to provide an ornamental accessory to eliminate the drawbacks with the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
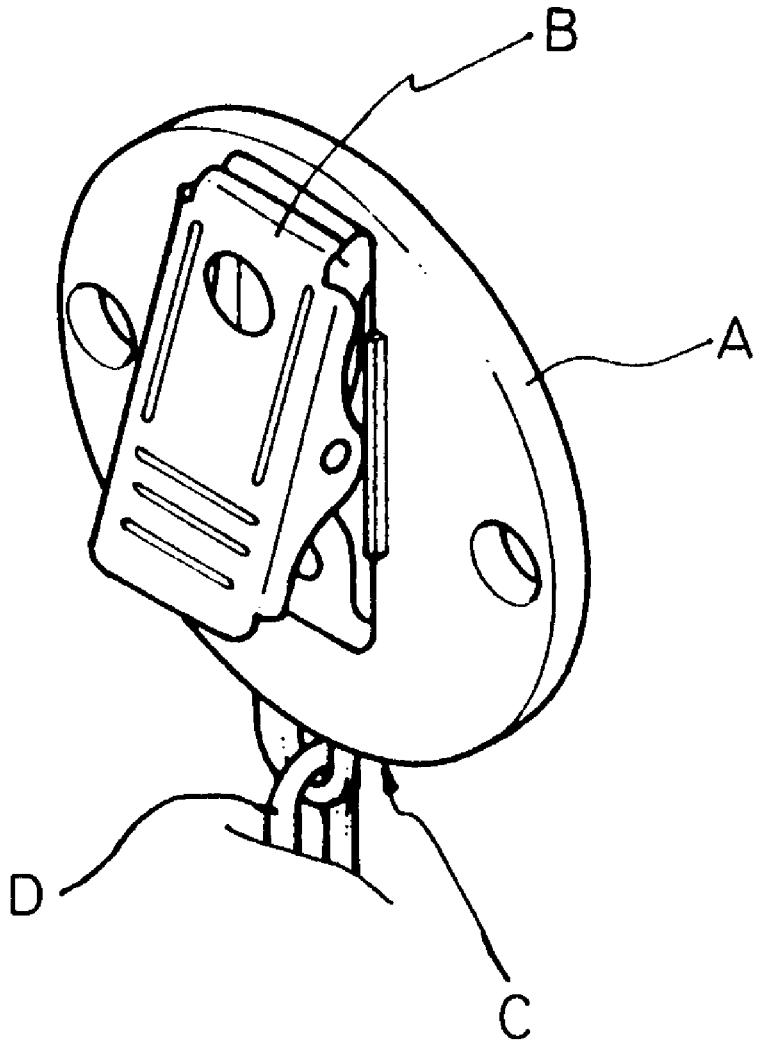
(PRIOR ART) FIG. 1
FIG. 1 is a schematic perspective view of the prior art.

With reference to FIGS. 2 to 5, the ornament accessory of the present invention is shown to comprise a face plate 1, a trigger plate 2, a movable clamp plate 3 and/or an ornamental plate 4.

The face plate 1 can be configured to have any shape, such as a geometric shape, to enhance the appearance of the ornamental accessory in terms of visual aesthetics. The face plate 1 has a plate face 11 on a front side that may be printed with a pattern or have a pattern adhered thereto to appeal to the wearer or user. A rear side of the face plate 1 is provided with a plate groove 12, with plate wings 13 projecting from both sides thereof respectively. The plate wings 13 are provided with symmetrical plate holes 14 and axial holes 15. In addition, one or more toothed portions 16 are provided below the two plate wings 13.

The trigger plate 2 is a multi-bend plate structure and includes pins 21 projecting from both ends of a bottom portion thereof, respectively, for insertion into the axial holes 15 to allow pivotal turning. Tapered rods 22 are integrally provided above the pins 21, with an L-shaped rod neck 23 extending therebetween. The rod neck 23 has a trigger piece 24 extending from an end portion thereof to allow manipulation of the trigger plate 2. Besides, in order to facilitate operation, two piece wings 25 extend outwardly from both sides of the trigger piece 24, respectively, so that the trigger piece 24 can be pulled from one side.

The movable clamp plate 3 is an inverted L-shaped structure that includes a clamp body 31 having a top portion that has two inverted L-shaped plate hooks 32 extending upwardly from positions corresponding to the rod neck 23 and plate wings 13. A plate shaft 33 extends laterally from the bent portion of each plate hook 32 for insertion into a respective one of the plate holes 14 to allow pivotal turning. Each plate hook 32 has an inner portion forming a rod recess for engaging the rod 22 in an inter-active relationship. One end of the recess 34 is provided with a stop boss 35. When the movable clamp 3 is in a clamping state, if the user pull the clamp body 31 forcefully, the stop bosses 35 will urge against the rods 22 so that the clamp body 31 cannot be pulled open. In addition, the clamp body 31 is provided with one or more toothed sections 36 for engaging the one or more toothed portions 16 in an opposed manner or in an alternate manner as shown in the drawings.

The ornamental plate 4 is shaped and sized to match the face plate 1 so that it can be coupled integrally thereto using an adhesive or fusion. The ornamental plate 4 has an ornamental face 41 on a front side that can be provided with a three-dimensional figurine or a pattern printed thereon or adhered thereto to appeal to consumers.

To widen the application of the ornamental accessory of the present invention, a lateral edge of the face plate is provided with a U-shaped groove 17 in which a projection 18 is disposed, and an insert rod 42 is provided on the rear side of the ornamental plate 4 corresponding to the projection 18 in position for insertion into the projection 18 to achieve positioning after assembly. A ring 51 of a chain 5 is fitted between the groove 17 and projection 18 so that the chain 5 is secured to one side of the face plate. A free end of the chain 5 is connected to a pacifier or whistle or the like.

To prevent possible suffocation if a child accidentally swallows the ornamental accessory, the face plate 1 is formed with a plurality of through air holes 19 at its periphery. The ornamental plate 4 is likewise provided with a plurality of through holes 43 corresponding to the air holes 19 to ensure smooth passage of air therethrough.

Figure 2:
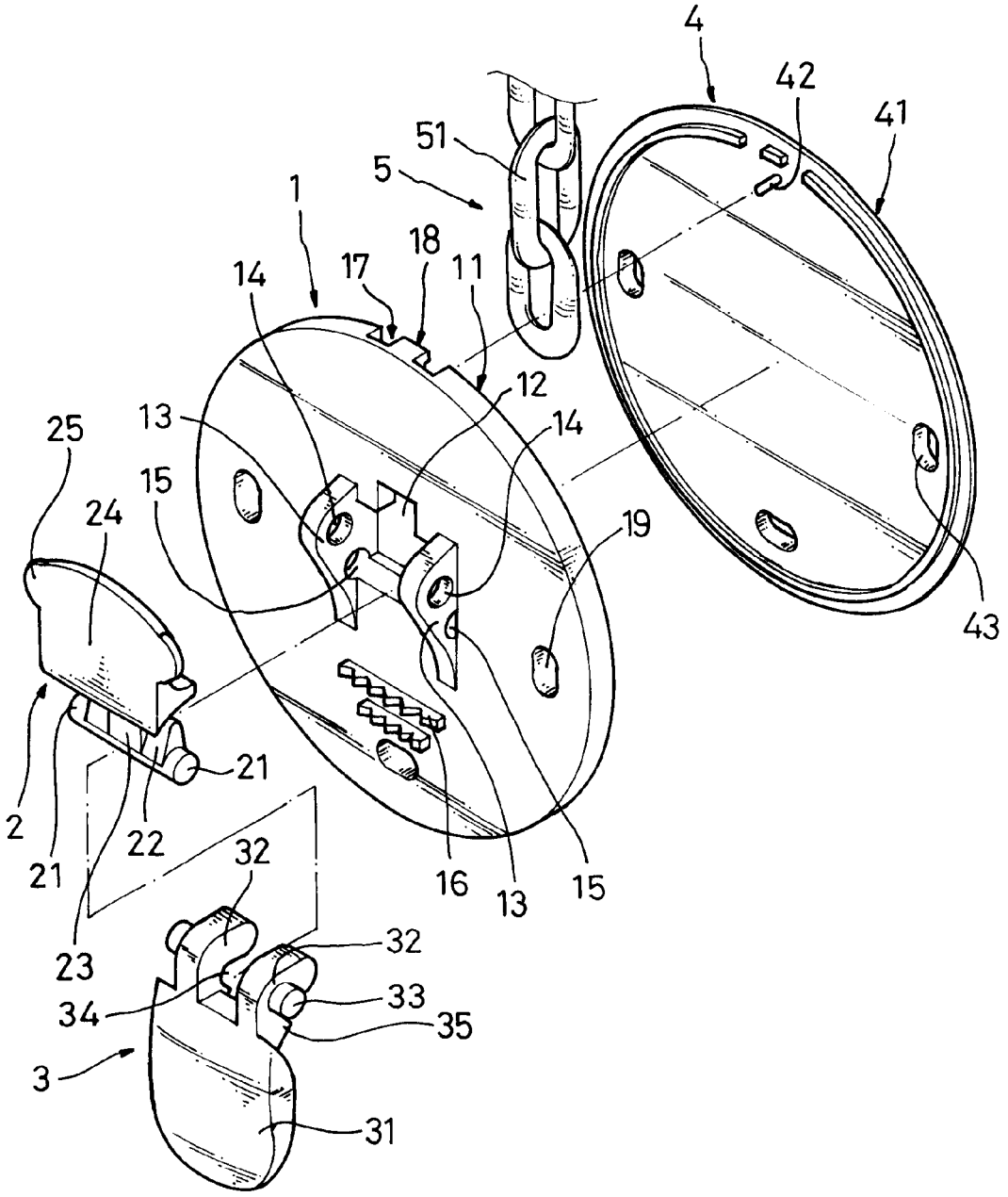
FIG. 2 is an exploded perspective view of the present invention.
Figure 4:
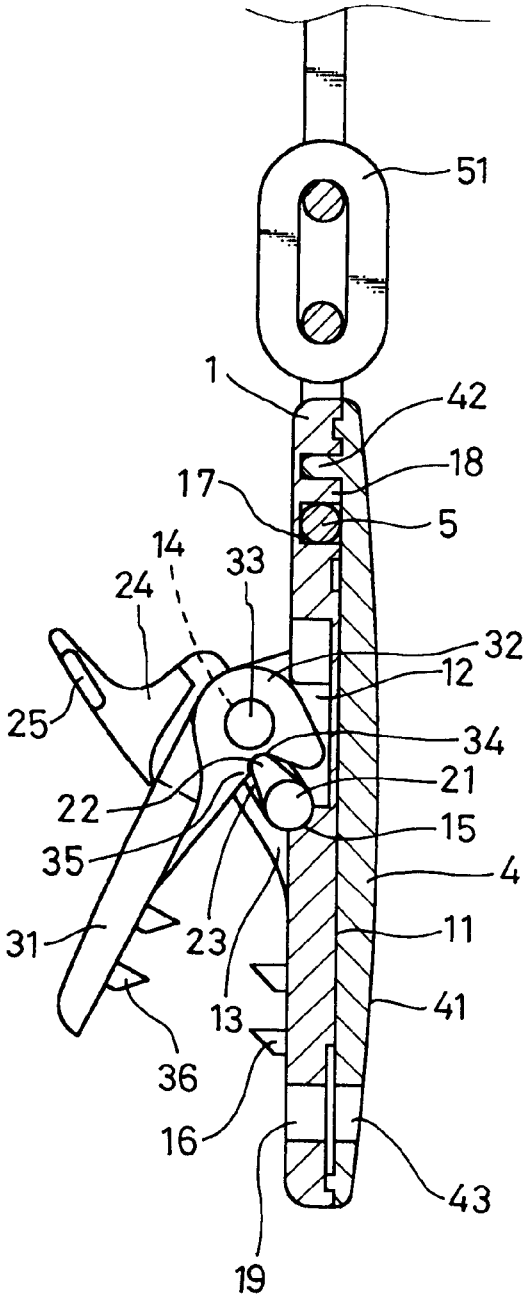
FIG. 4 is an assembled sectional view of the present invention, showing the present invention in an open state.
Figure 3:
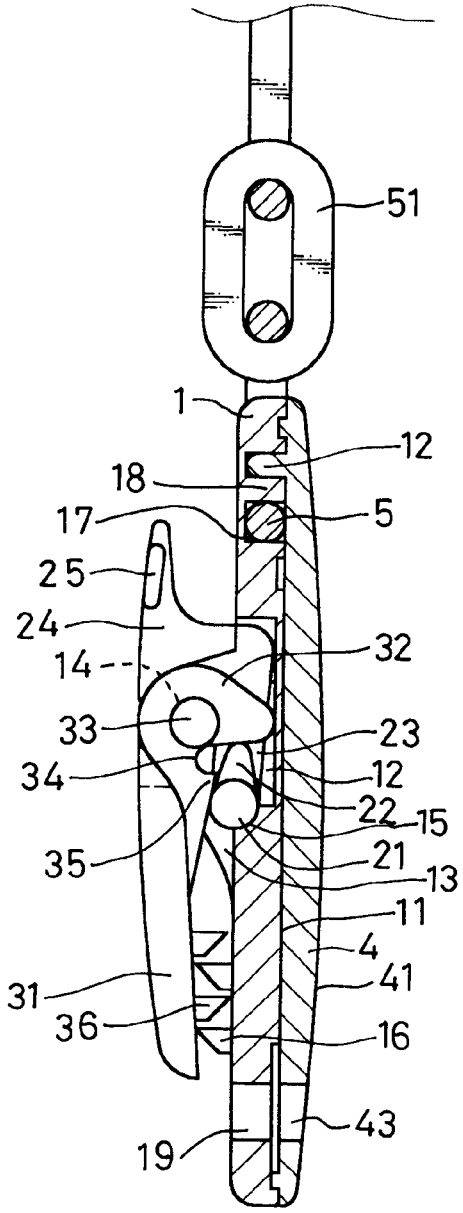
FIG. 3 is an assembled sectional view of the present invention, showing the present invention in a clamping state.
Figure 5:
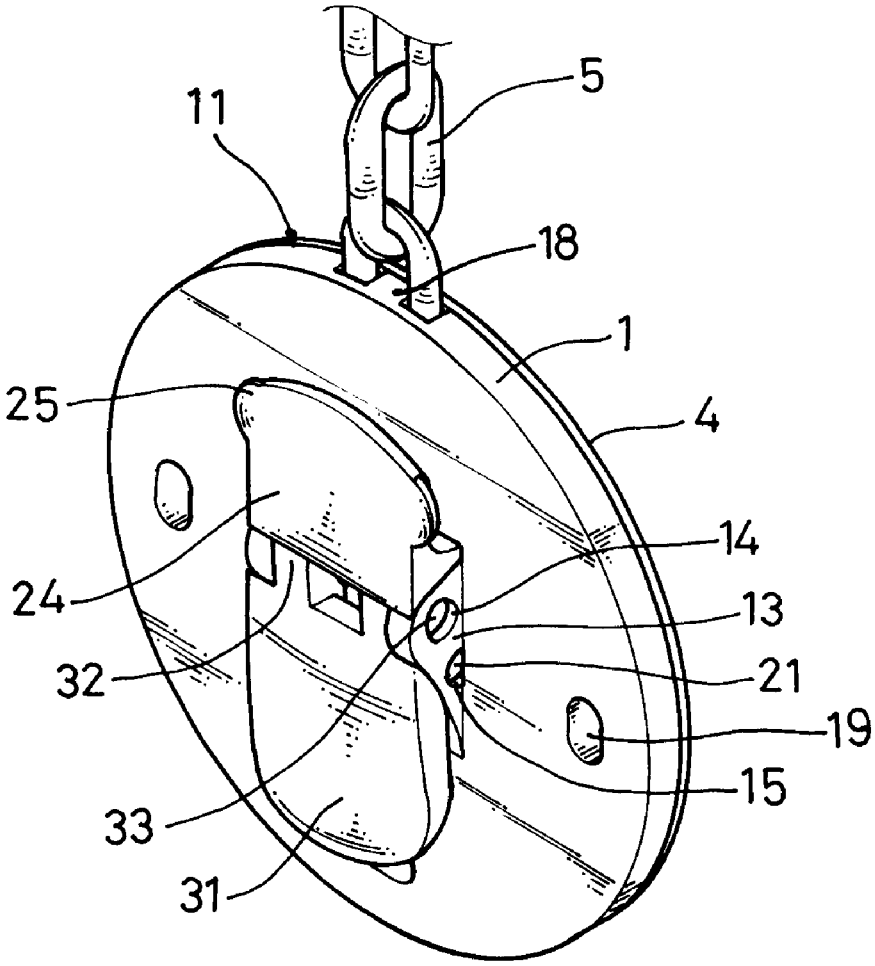
FIG. 5 is an assembled perspective view of the present invention.

Referring to FIGS. 2 to 4, in assembly, the rods 22 of the trigger plate 2 and the rod recesses 34 of the movable clamp plate 3 are joined so that the bottom edge of the trigger piece 24 urges against the bent portion of the plate hooks 32. Then, the pins 21 and the plate shafts 33 are inserted into the axial holes 15 and plate holes 14, respectively, whereby the trigger plate 2 and the movable clamp plate 3 can be secured on the rear side of the face plate 1. The front side of the face plate 1 may be selectively coupled with the ornamental plate 4. In this manner, assembly of the ornamental accessory of the present invention is accomplished.

During operation, it is only necessary to pull the trigger piece 24 upwardly so that the rods 22, using the axial holes 15 as center of axis, turn upwardly to advance along inner walls of the plate hooks 32 into the rod recesses 34. During the process of turning of the rods 22, due to the action of the rod recesses 34, the clamp body 31 utilizes the plate holes 14 as center of axis and has its bottom portion tilting upwardly, thereby forming a relatively large clearance between the toothed portion 16 and toothed section 36 (see FIG. 4) to allow the ornamental accessory of the present invention to detach from the wearer's clothing. On the contrary, if the ornamental accessory of the present invention is to be attached to the wearer's clothing, it is only necessary to slip the clearance between the clamp body 31 and the face plate 1 onto the edge of the wearer's clothing and then press the trigger piece 24 downwardly so that the rods 22 turn downwardly to disengage from the rod recesses 34. As the plate hooks 32 lose support of the rods 22, the clamp body 31 at the other end thereof is caused to displace downwardly, thereby bringing the toothed portions 36, 16 into engagement with each other (see FIG. 3). In this way, the ornamental accessory of the present invention can be attached to the user's clothing firmly.

In the present invention, since the components are coupled with the ornamental portion by means of fusion or adhesive, the ornamental accessory will not have any sharp edges or burrs that may scratch the wearer. Besides, as the trigger plate and the movable clamp plate are planar and flat, they can firmly attach to the wearer's clothing and will not easily slip therefrom when touched. Furthermore, the present invention is simple in construction and easy to assemble and is cost economical. Moreover, the opening or closing of the clamp body is controlled by the trigger plate, i.e., a clearance is formed when the trigger plate is pulled open and the toothed portion of the movable plate and the toothed section of the face plate engage each other when the trigger plate is pressed downwardly. Lastly, the provision of the air holes and through holes prevents possible suffocation of children who accidentally swallow the ornament accessory of the present invention, hence meeting the CE standard of the European Community.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved structure of ornamental accessory, comprising:

a face plate having a rear side provided with a plate groove having opposite sides, and plate wings projecting from the opposite sides of said plate groove, respectively, said plate wings having symmetrical plate holes and axial holes, a portion of said rear side of said face plate being provided with at least one toothed portion;

a trigger plate being a multi-bend plate structure with a bottom portion and including pins projecting from said bottom portion thereof and inserted into said axial holes to allow pivotal turning of the trigger plate, tapered rods being integrally provided above said pins, an L-shaped rod neck extending between said tapered rods and having a trigger piece extending from an end portion thereof; and a movable clamp plate having a clamp body having a top portion that has two inverted L-shaped plate hooks extending upwardly therefrom at positions corresponding to said rod neck and plate wings, a plate shaft extending laterally from each of said plate hooks and inserted into a respective one of said plate holes to allow pivotal turning of the clamp plate, each of said plate hooks having an inner portion forming a rod recess, with a stop boss projecting from one end thereof, said clamp body having at least one toothed section, whereby when said trigger plate is pulled, said rods utilize said axial holes as centers of axis and turn upwardly to advance along inner walls of said plate hooks into said rod recesses, whereas said clamp body utilizes said plate holes as axis centers and tilts upwardly so that a clearance is defined between said at least one toothed portion and said at least one toothed section to fit onto an object to be clamped.

2. The improved structure of an ornamental accessory as defined in claim 1, wherein said face plate has a front side for receiving a pattern thereon.

3. The improved structure of an ornamental accessory as defined in claim 1, wherein said at least one toothed portion and said at least one toothed section are engaged in an alternate manner.

4. The improved structure of an ornamental accessory as defined in claim 1, wherein said trigger piece of said trigger plate has opposite sides and has piece wings projecting from the opposite sides.

5. The improved structure of an ornamental accessory as defined in claim 1, wherein said trigger plate and clamp plate are movable to a clamping state wherein said stop bosses urge against said rods when said movable clamp plate and said face plate are in the clamping state.

6. The improved structure of an ornamental accessory as defined in claim 1, further comprising an ornamental plate that is shaped and sized to match said face plate and is coupled integrally to the face plate, said ornamental plate having an ornamental face.

7. The improved structure of an ornamental accessory as defined in claim 6, wherein said ornamental face of said ornamental plate has a pattern thereon.

8. The improved structure of an ornamental accessory as defined in claim 6, wherein a lateral edge of said face plate has a U-shaped groove in which a projection is disposed, an insert rod being provided on a rear side of said ornamental plate corresponding to said projection for insertion into said projection, a ring of a chain being fitted between said groove and said projection so that said chain is secured to one side of said face plate.

9. The improved structure of an ornamental accessory as defined in claim 6, wherein said face plate has a plurality of air holes to prevent suffocation of children who accidentally swallow said ornamental accessory.

10. The improved structure of an ornamental accessory as defined in claim 9, wherein said ornamental plate is provided with a plurality of through holes in positions corresponding to said plurality of air holes of said face plate to ensure smooth circulation of air.

* * * * *